US008091607B2

(12) United States Patent
Aquilina

(10) Patent No.: US 8,091,607 B2
(45) Date of Patent: Jan. 10, 2012

(54) GARAGE DOOR BRACKET ASSEMBLY WITH SLIDABLE ROLLER HOUSING

(75) Inventor: Anthony George Aquilina, Milton (CA)

(73) Assignee: Anthony George Aquilina, Milton (CA)

( * ) Notice: Subject to any disclaimer, the term of this patent is extended or adjusted under 35 U.S.C. 154(b) by 0 days.

(21) Appl. No.: 11/429,110

(22) Filed: May 5, 2006

(65) Prior Publication Data

US 2007/0256798 A1 Nov. 8, 2007

(51) Int. Cl.
*E05D 15/26* (2006.01)

(52) U.S. Cl. ..... 160/201

(58) Field of Classification Search ..... 16/97; 160/201, 160/193, 191, 192
See application file for complete search history.

(56) References Cited

U.S. PATENT DOCUMENTS

| | | | | | |
|---|---|---|---|---|---|
| 2,239,273 | A | * | 4/1941 | Rowe et al. | 160/201 |
| 2,525,309 | A | * | 10/1950 | Norberg | 16/97 |
| 3,188,698 | A | * | 6/1965 | Zoll et al. | 49/322 |
| 3,376,913 | A | * | 4/1968 | Clapsaddle | 160/201 |
| 3,412,780 | A | * | 11/1968 | Moler | 160/191 |
| 3,484,812 | A | * | 12/1969 | Holland | 160/201 |
| 4,986,099 | A | * | 1/1991 | Johnson et al. | 70/277 |
| 5,404,927 | A | * | 4/1995 | Bailey | 160/201 |
| 5,495,640 | A | | 3/1996 | Mullet et al. | |
| 5,508,691 | A | * | 4/1996 | Castleman et al. | 340/5.24 |
| 5,865,235 | A | | 2/1999 | Krupke et al. | |
| 5,918,660 | A | * | 7/1999 | Crawford et al. | 160/201 |
| 5,974,738 | A | * | 11/1999 | Jacobs | 49/425 |
| 6,082,430 | A | | 7/2000 | Mock | |
| 6,094,779 | A | | 8/2000 | Young | |
| 6,098,697 | A | * | 8/2000 | Krupke et al. | 160/229.1 |
| 6,112,464 | A | * | 9/2000 | Grisham et al. | 49/199 |
| 6,263,948 | B1 | * | 7/2001 | Whitley | 160/201 |
| 6,363,993 | B1 | | 4/2002 | Aquilina | |
| 6,401,793 | B1 | * | 6/2002 | Martin | 160/191 |
| 6,463,625 | B2 | * | 10/2002 | Mittag | 16/97 |
| 6,572,274 | B1 | * | 6/2003 | Margaliot et al. | 385/75 |
| 6,588,482 | B2 | * | 7/2003 | Wright | 160/193 |
| 6,615,898 | B2 | * | 9/2003 | Schulte | 160/201 |
| 6,742,564 | B2 | | 6/2004 | Martin | |
| 6,891,480 | B2 | * | 5/2005 | Williams et al. | 340/693.6 |
| 6,983,512 | B2 | * | 1/2006 | De Oliveira | 16/97 |
| 7,600,344 | B2 | * | 10/2009 | Michaud | 49/322 |
| 2006/0260247 | A1 | * | 11/2006 | Monteer | 52/520 |
| 2007/0044927 | A1 | * | 3/2007 | Mullet et al. | 160/201 |
| 2007/0215293 | A1 | * | 9/2007 | Stone et al. | 160/201 |

FOREIGN PATENT DOCUMENTS

| | | |
|---|---|---|
| CA | 2 343 682 | 10/2001 |

OTHER PUBLICATIONS

International Search Report for International Application No. PCT/IB2006/003813; Applicant: Anthony George Aquilina; Date of Mailing of Search Report Nov. 26, 2007, 3 Pages.

* cited by examiner

*Primary Examiner* — Katherine Mitchell
*Assistant Examiner* — Candace L Bradford
(74) *Attorney, Agent, or Firm* — Fay Sharpe LLP

(57) ABSTRACT

The disclosure relates to a garage door assembly. The garage door assembly includes a plurality of interconnected garage door panels, a track and a cable. A bracket assembly is attached to one of the panels. The bracket assembly includes a moveable member including a roller which is rotatably received in the track. A fixed member is attached to a panel and includes a portion to which the cable is attached. The moveable member selectively accommodates the fixed member.

19 Claims, 6 Drawing Sheets

GARAGE DOOR BRACKET ASSEMBLY WITH SLIDABLE ROLLER HOUSING

BACKGROUND

The present invention relates to a garage door assembly. More particularly, the present invention relates to a bottom bracket having a slidable roller housing for an upward acting or vertical opening sectional garage door or single panel garage door.

One problem associated with lightweight and heavy doors constructed of sheet metal, extruded aluminum, as well as polymer materials, has been the provision of suitable brackets for transferring loads from door counterbalance or lifting cables to the door structure itself. A particular problem has been the lowermost bracket for guiding the door for movement between open and closed positions. Desirably, the brackets should be arranged in such a way as to minimize inadvertent disconnection of the bracket from the door when the door counterbalance or lifting cables are under high tension, so as to minimize the chance of injury, damage to the door structure and/or damage to the counterbalance mechanism.

A conventional bottom bracket generally includes a cable attachment and a roller housing for securing a guide member therein. The roller housing typically includes spaced apart flanges stamped out of the bottom bracket, each flange having at least one hole dimensioned to receive a shaft of a roller of the guide member. The flanges of the roller housing are typically positioned on the bottom bracket at a predetermined distance from a side edge and a bottom edge of the bottom bracket. This distance varies when different sized roller diameters (generally 2" or 3" diameters depending on the size of tracks of the garage door) are used.

In some cases the flange holes for the roller shaft are slightly larger than the roller shaft such that an end of the shaft can slip out of one of the flange holes. This slippage can prevent the roller shaft from floating sideways in the roller housing during movement of the door thereby causing the roller to bind in between the roller flanges. In these instances, a tube, typically formed of sheet metal, can be inserted through the holes. The roller shaft is then inserted in the tube. A roller with a longer shaft can be used with or without a tube to prevent the roller shaft from slipping out of the flange holes or the tube.

Recently, bottom brackets have included separate U-shaped roller housings. The U-shaped roller housing is generally fastened, such as by a rivet or screw, to a surface of the bottom bracket. Each arm of the U-shaped roller housing includes a pair of holes for either a 2" roller or a 3" roller. Because the holes are so close to each other, insert tubes for roller shafts generally can not be used.

On problem associated with the fastening of the U-shaped roller housing to the bottom bracket is that screws can loosen, which can cause the roller housing to disengage from the bottom bracket. With a riveted roller housing, in order to remove or replace the guide member, the entire bottom bracket has to be removed. Because of the tremendous tension and pressure transferred to the cables from the lifting mechanism, the removal of the bottom bracket, which is attached to the cables, can be dangerous. In addition, it is very time consuming to release the pressure from the lifting mechanism just to replace a guide member. Another method in replacing the guide member without having to remove the entire bottom bracket is to bend the door track channel outward and force the roller out of the track. The door panel is then pulled out of its operating position in order to replace the roller. However, this pulling method can be cumbersome when the door track channel is secured to a steel frame or is installed too close to the garage door structure.

Accordingly, there is a need for a new and improved bottom bracket which overcomes certain difficulties and safety issues with the prior art designs while providing better and more advantageous overall results.

BRIEF DESCRIPTION

In accordance with one aspect of the present invention, a garage door assembly includes a plurality of interconnected garage door panels, a track and a cable. A bracket assembly is attached to one of the panels. The bracket assembly includes a moveable member including a roller which is rotatably received in the track. A fixed member is attached to a panel and includes a portion to which the cable is attached. The fixed member selectively accommodates the moveable member.

In accordance with another aspect of the present invention, a garage door assembly includes a bottom door panel, a track and a bracket assembly attached to the bottom door panel. The bracket assembly comprises a fixed member and a moveable member. The fixed member is attached to the bottom door panel. The moveable member is slidably mounted on the fixed member. The moveable member comprises at least two longitudinally extending bores. Each of the bores selectively accommodates an axle of a roller mounted in the track.

In accordance with yet another aspect of the present invention, a garage door assembly comprises a bottom door panel, a track, a cable and a bracket assembly attached to a lower corner of the bottom door panel. The bracket assembly includes a moveable member including a roller which is received in the track. A fixed member is attached to the bottom door panel. The fixed member comprises a first panel, a second panel and a third panel. The second panel is oriented approximately transverse to the first panel. The third panel is oriented approximately transverse to both the first panel and the second panel. The moveable member is mounted to the first panel of the fixed member.

Still other aspects of the invention will become apparent from a reading and understanding of the detailed description of the several embodiments described hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the disclosure.

DETAILED DESCRIPTION

Figure 1:
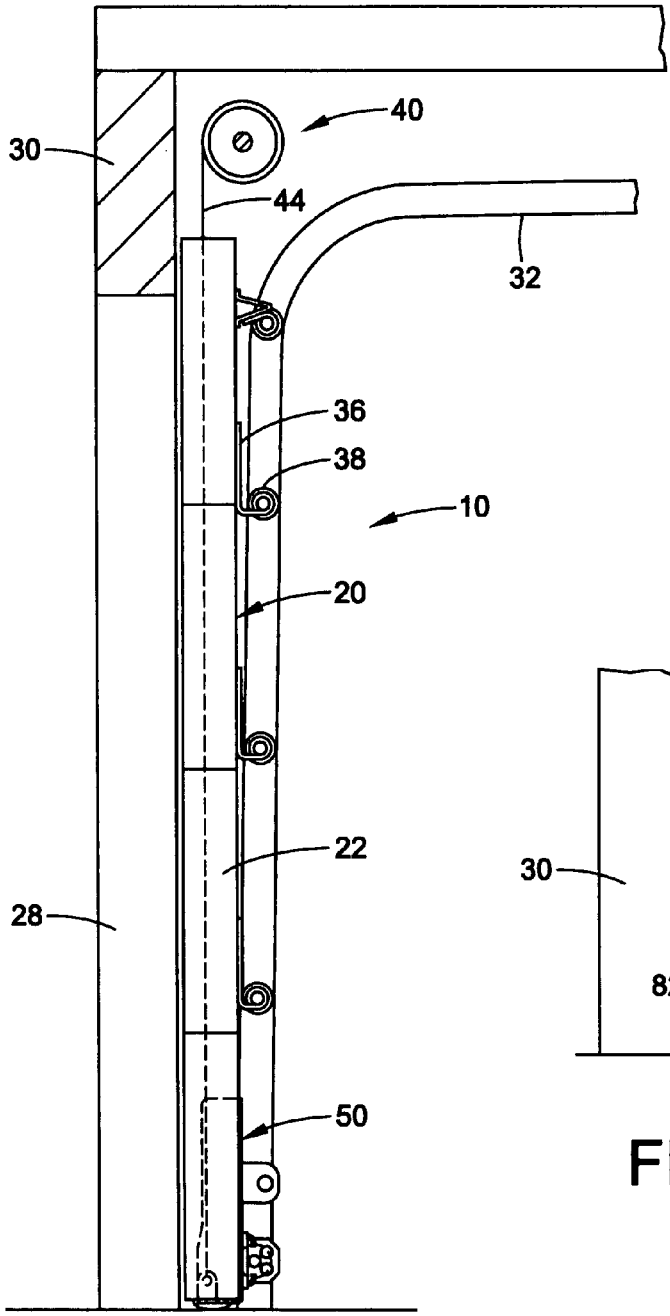
FIG. 1 is schematic side elevational view of a garage door assembly comprising a plurality of interconnected garage door panels and a bottom bracket assembly, attached to the lowermost panel, in accordance with a first embodiment of the present invention.

It should, of course, be understood that the description and drawings herein are merely illustrative and that various modifications and changes can be made in the structures disclosed without departing from the scope and spirit of the invention. Like numerals refer to like parts throughout the several views. It will also be appreciated that the various identified components of the garage door assembly disclosed herein are merely terms of art that may vary from one manufacturer to another and should not be deemed to limit the present invention. All references to direction and position, unless otherwise indicated, refer to the orientation of the garage door assembly illustrated in the drawings.

Figure 1A:
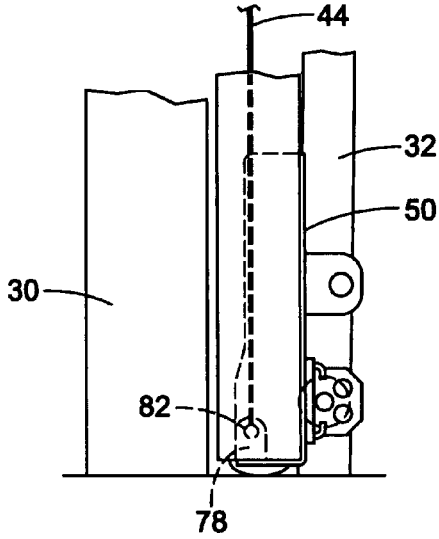
FIG. 1A is an enlarged schematic view of the bottom bracket assembly of FIG. 1.

Referring now to the drawings, wherein the drawings illustrate several embodiments of the present invention only and are not intended to limit same, FIGS. 1 and 1A illustrate a garage door assembly, generally designated by the numeral 10. The garage door assembly includes an upwardly openable door 20 including, in one embodiment, a plurality of generally planar door panels 22 which can be interconnected by suitable hinge assemblies (not illustrated) mounted to cooperating adjacent edges of the door panels. The door 20 is supported for movement between the closed position shown, which closes an opening 28 in a wall 30, and an open position by spaced apart guide tracks 32 (only one being illustrated in FIG. 1). Opposed first guide members 36 are mounted on the door 20 at spaced apart positions. The first guide members include rollers 38 which are retained in the guide tracks in a known manner for supporting the door in its open and closed positions and for guiding the door during movement therebetween.

Figure 3:
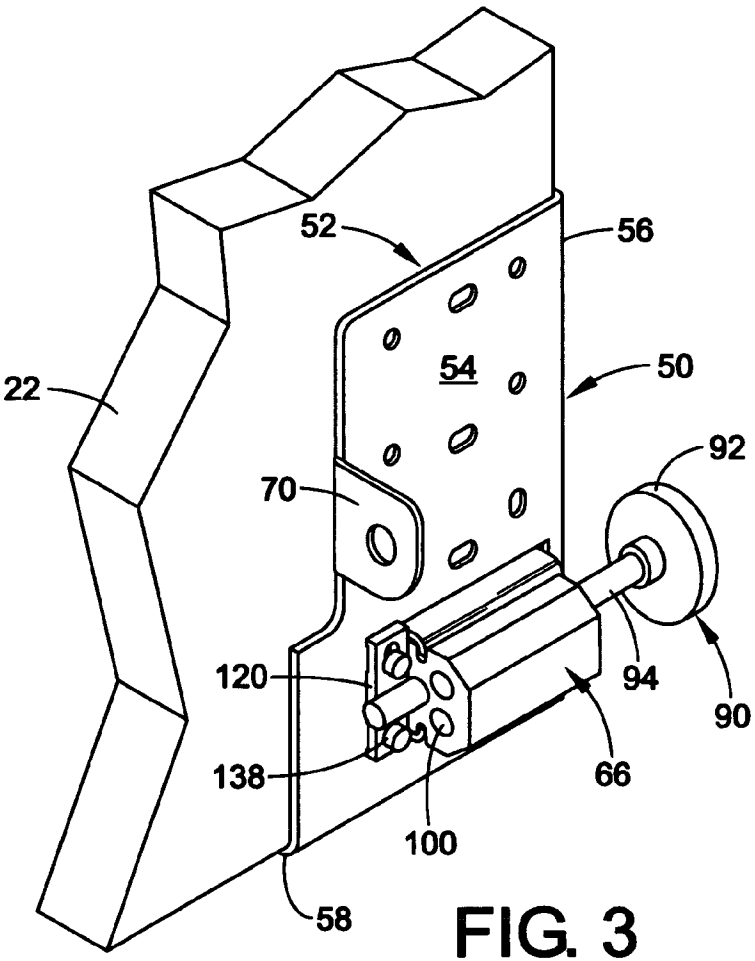
FIG. 3 is an enlarged front perspective view, with the door partially broken away, of a right-hand bottom bracket assembly according to the present invention attached to a second side edge of the lowermost garage door panel.
Figure 2:
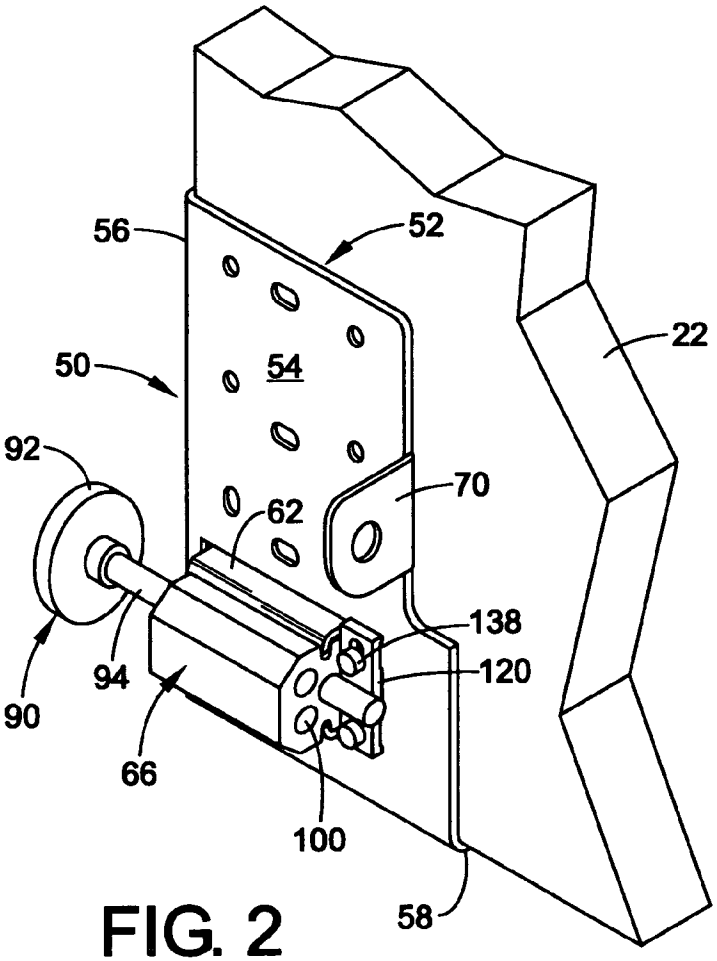
FIG. 2 is an enlarged front perspective view, with the door partially broken away, of a left-hand bottom bracket assembly of the present invention attached to a first side edge of the lowermost garage door panel.

A suitable counterbalance and/or lifting mechanism 40 is mounted on a wall, generally above and adjacent to the door 20. It is connected to the door by spaced apart depending flexible members, such as cables 44 (only one being shown), also in a generally known manner. An operator mechanism for moving the door 20 between open and closed positions may be of a conventional type. Each depending cable 44 is connected to the lowermost garage door panel 22 at opposite side edges thereof by way of opposed bottom brackets, each generally designated by the numeral 50. What is termed a left-hand bracket assembly is illustrated in FIG. 2 and what is termed a right-hand bottom bracket assembly is illustrated in FIG. 3. Since the bracket assemblies are mirror images of each other, only the right hand bracket assembly will be discussed herein. However, it should be evident that the left-hand bracket assembly includes mirror images of the same components.

Figure 4:
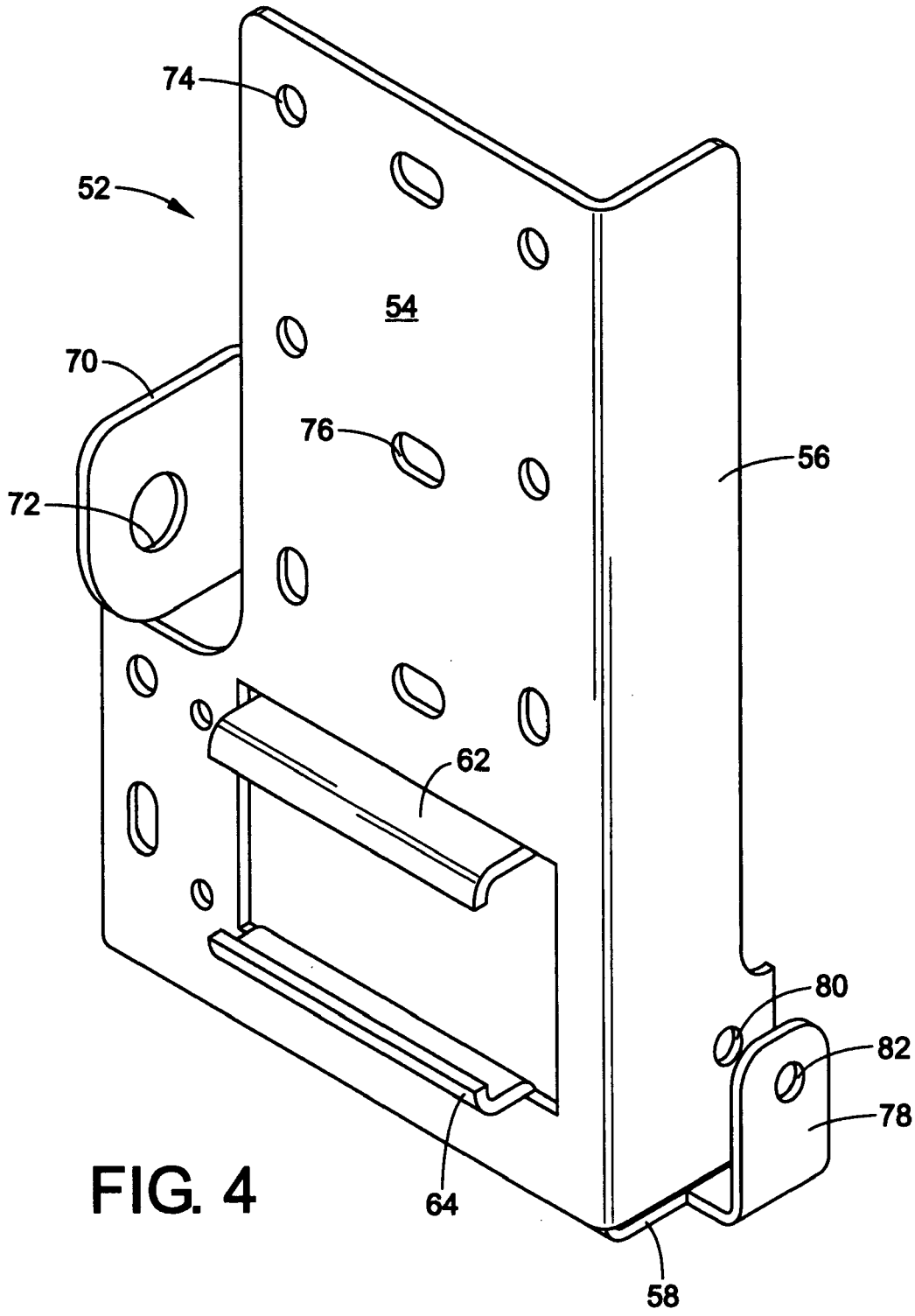
FIG. 4 is an enlarged front perspective view of a bracket of the right-hand bracket assembly of FIG. 3.
Figure 5B:
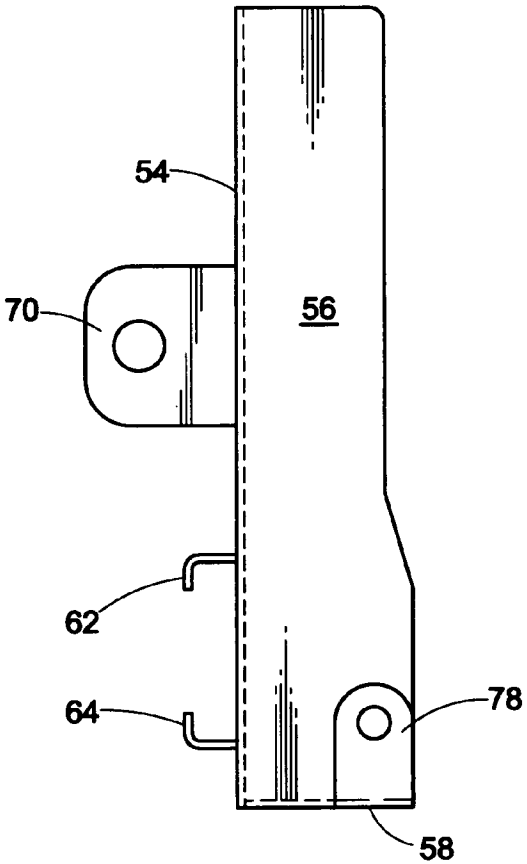
FIG. 5B is a side elevational view of the bracket of FIG. 4.
Figure 5A:
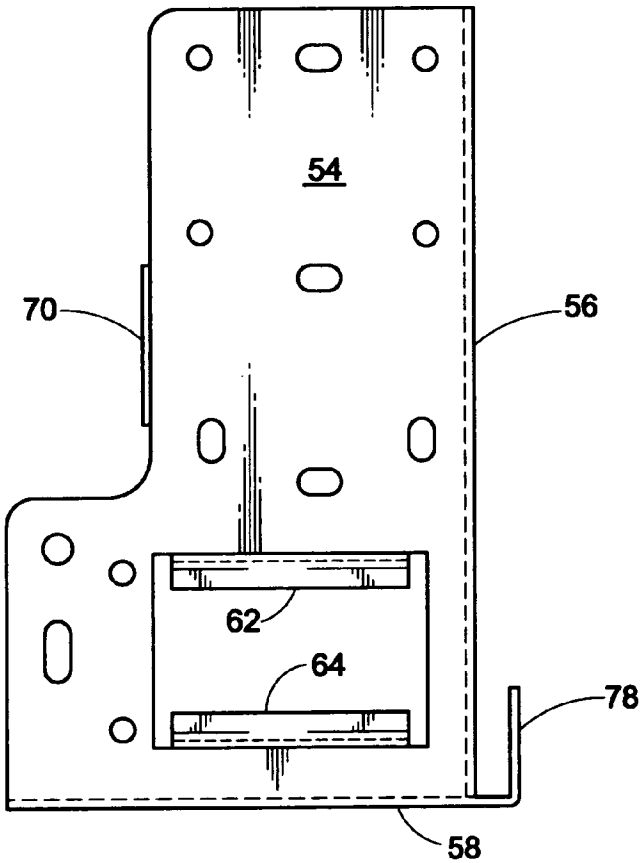
FIG. 5A is a front elevational view of the bracket of FIG. 4.

With reference to FIGS. 4, 5A and 5B, the bracket assembly 50 includes a fixed member or bracket 52 generally comprising a front plate 54, a side plate 56 and a bottom plate 58. A first flange 62 and a second flange 64, which is spaced from the first flange, extend outwardly from the front plate. The first and second flanges can be stamped out of the front plate 54. In the depicted embodiment, the first and second flanges are generally L-shaped; although, this is not required. Other shapes can be contemplated as well. As will be discussed in greater detail below, the first and second flanges 62, 64 are adapted to selectively accommodate a moveable member or roller housing 66. The bracket 52 further includes a tab 70 having a hole 72 extending outwardly from the front plate 54 for the attachment of a pull cord (not shown) or the like.

The bracket 52 can be attached to the lowermost garage door panel 22 via conventional means. For example, fasteners, such as screws, can extend through generally round and/or generally slotted openings 74 and 76, respectively, located on the front plate 54 of the bracket and threadingly engage the garage door panel 22. It should be appreciated that alternative means for securing the bracket 52 to the garage door panel 22 is also contemplated. As shown in FIGS. 2 and 3, once secured to the panel, the front, side and bottom plates 54-56 of the bracket abut respective front, side and bottom surfaces of the door panel.

Figure 8:
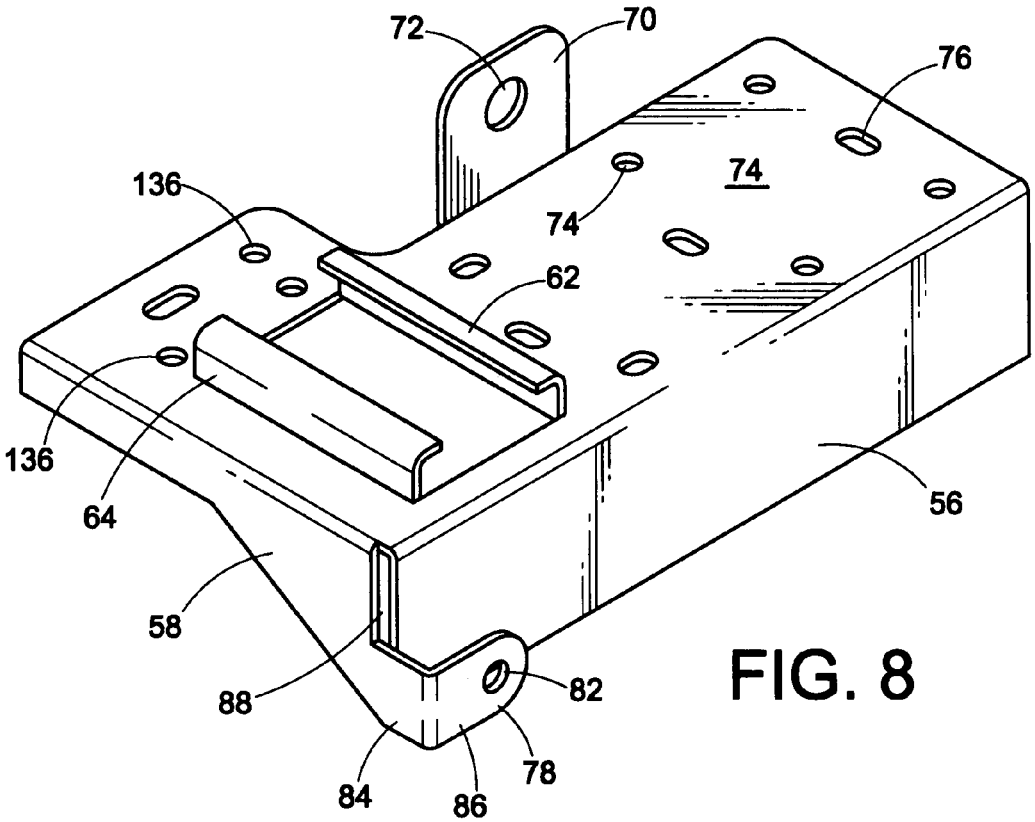
FIG. 8 is an enlarged side perspective view of the bottom bracket of FIG. 4.

As indicated above, the right-hand bracket assembly 50 is connected to a right hand one of the cables 44. Particularly, and with reference to FIG. 1A, each of the cables can be provided with a becket or eye (not shown) at its free end. The cable becket is adapted to engage a cable mount or arm 78 extending from one of the side plate 56 and bottom plate 58 of the bracket. In the depicted embodiment of FIG. 8, the cable mount or arm is generally L-shaped. It includes a first section 84 and a second section 86. The first section 84 extends outwardly and upwardly from a side edge 88 of the bottom plate 58. To secure the cable to the cable mount 78, a stem can be inserted through the cable becket, the ends of the stem being secured in aligned apertures 80 and 82 located on the side plate 56 and the cable mount 78, respectively. Alternatively, the cable becket can be attached to a flanged lug mounted in one of the aperture 80 and 82. It should be appreciated that other means for securing the cable to the bracket assembly 50 are also contemplated.

Figure 6:
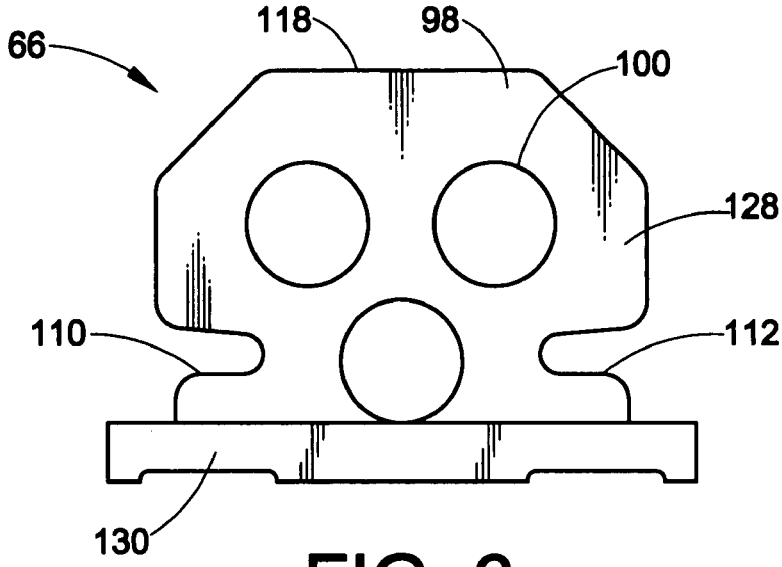
FIG. 6 is an enlarged front elevational view of a moveable roller housing of the bottom bracket assembly of FIG. 3.
Figure 7:
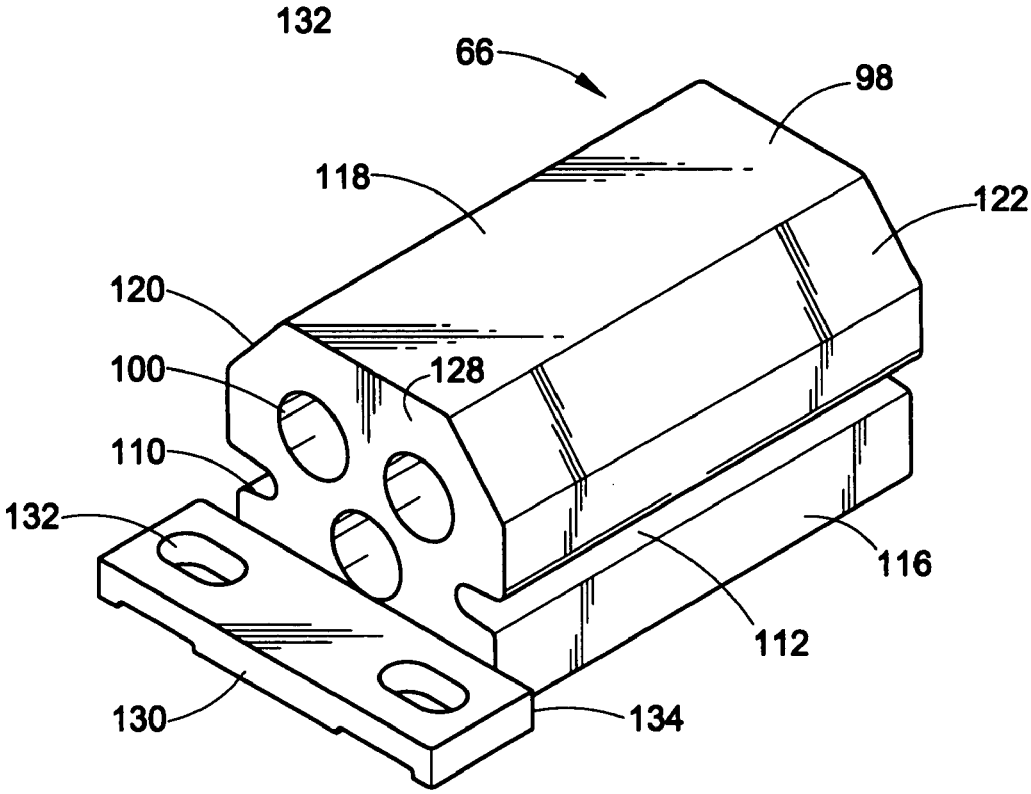
FIG. 7 is a front perspective view of the moveable roller housing of FIG. 6.

With reference again to FIG. 3, the roller housing 66 of the bracket assembly 50 is adapted to support a second guide member 90. The second guide member includes a roller 92 mounted on an elongated, generally cylindrical shaft member or axle 94. The rollers 92 of the two bracket assemblies are adapted to be retained in the guide tracks 32. As indicated above, the roller housing 66 is slidably mounted on the bracket 52. As shown in FIGS. 6 and 7, the roller housing comprises a body 98 including at least two longitudinally extending bores 100. In the depicted embodiment, the roller housing includes three longitudinally extending bores arranged in a triangular fashion. Each of the bores is dimensioned to selectively accommodate the axle 94 of the second guide member 90. An end of the axle can include a hole (not shown) for a cotter pin, spring clip or the like to prevent the roller housing 66 from sliding out of the first and second flanges 62 and 64.

The lower bore can be used for second guide members having a two inch (2") roller and the upper bores can be used for second guide members having a three inch (3") roller. The upper two bores are generally used for left and right hand applications when three inch rollers are used. For residential garage doors, which generally are much lighter than industrial and commercial garage doors, the roller housing 66 can include only one or two bores, a second bore being used for attachment of a safety mechanism to prevent the door from dropping in case the cable 44 breaks and/or the lifting mechanism 40 fails. The roller housing can be made of solid materials, such as plastic, metal or the like, and can be molded or cast. It can also be machined out of a solid block of material. Alternatively, it can be extruded from plastic, aluminum or the like.

With continued reference to FIGS. 6 and 7, in this embodiment, the roller housing 66 also includes a first shoulder 110 which slidingly cooperates with the first flange 62 and a second shoulder 112 which slidingly cooperates with the second flange 64. The shoulders 110 and 112 are defined in opposed side walls 114 and 116 of the body 98 of the roller housing 66. It should also be evident that the body 98 also includes a top wall 118 and a pair of angled walls 120 and 122. Of course, other designs are also contemplated. To mount the roller housing 66 to the bracket 52, the first and second shoulders are aligned with the first and second flanges 62 and 64. In this position, the roller housing can be slid onto the flanges of the bracket.

A flange 130 extends away from an end wall 128 of the roller housing 66. The flange includes at least one mounting aperture 132 for receiving at least one fastener 138 (FIGS. 2 and 3). The fastener cooperates with the flange to selectively secure the roller housing to the bracket 52. It should be apparent from FIG. 7 that the flange 130 is wider than the body 98. This construction prevents the roller housing 66 from sliding too far into the opening formed by the first and second bracket flanges 62 and 64. However, when a flange back wall 134 is butted up against the edges of the bracket flanges 62 and 64, the flange apertures 132 are aligned with apertures 136 in the bracket 52 to allow the fasteners 138 to extend therethrough. Removal or replacement of a second guide member 90 is made simple by removing the fasteners 138 (and possibly a cotter pin or spring clip attached on the axle end), sliding the roller housing 66 out of the bracket 52 and removing the second guide member 90 from the guide track 32. This eliminates possible injuries to the user, potential damage to the door structure and/or the counterbalance mechanism and the extended time needed to replace the guide member.

The present invention has been described with reference to several embodiments. Obviously, modifications and alterations will occur to others upon reading and understanding the preceding detailed description. It is intended that the present invention be construed as including all such modifications and alterations insofar as they come within the scope of the appended claims or the equivalents thereof.

What is claimed is:

1. A garage door assembly comprising:

a plurality of interconnected garage door panels, each panel including a front surface, a side surface and a bottom surface;

a track;

a cable;

a bracket assembly attached to one of the panels, said bracket assembly including:

a moveable member comprising a one-piece body including a planar surface, said body of said moveable member including a longitudinal bore for selectively accommodating an axle of a roller which is rotatably received in said track, said planar surface and said bore being generally coextensive along a major portion of their respective lengths, and a fixed member attached to a single panel, said fixed member configured to abut at least two surfaces of said single panel, said fixed member including first and second flanges for selectively engaging said moveable member, said fixed member including a portion to which said cable is attached, wherein said moveable member is slidably mounted to said fixed member in a single direction generally transverse to a longitudinal axis of said track such that said first and second flanges interlock with cooperating surfaces of the moveable member to restrict separation of the moveable member from the the fixed member, and such that pivotable movement is not possible between the moveable and fixed member, said planar surface of said body facing said fixed member.

2. The assembly of claim 1, wherein said fixed member comprises:

a plate;

the first flange which protrudes from said plate; and the second flange which protrudes from said plate and is spaced from and oriented generally parallel to said first flange, the second flange being a mirror mage of said first flange.

3. The assembly of claim 2, wherein said fixed member further comprises a third flange to which said cable is attached.

4. The assembly of claim 3, wherein said fixed member further comprises an end wall extending approximately normal to said plate, said end wall configured to abut said bottom surface of the panel, said third flange extending from said end wall.

5. The assembly of claim 4, wherein said fixed member further comprises a side wall extending approximately normal to said plate, said side wall configured to abut said side surface of the panel.

6. The assembly of claim 1, wherein said body of said moveable member comprises a first longitudinally extending shoulder which cooperates with said first flange and a second longitudinally extending shoulder which cooperates with said second flange.

7. The assembly of claim 1, wherein said moveable member further comprises a flange located outwardly of one side edge of said body of said movable member.

8. The assembly of claim 7, further comprising a fastener which cooperates with said flange of said moveable member to selectively secure said moveable member to said fixed member.

9. A garage door assembly comprising:

a bottom door panel;

a track;

a bracket assembly attached to said bottom door panel, said bracket assembly comprising:

a fixed member attached to said bottom door panel and including a first protruding flange, and a moveable member slidably mounted on said fixed member, said moveable member comprising a body including first and second side edges extending longitudinally and first and second end edge, such that said first and second flanges interlock with cooperating surfaces of the moveable member to restrict separation of the moveable member from the fixed member, and such that pivotable movement is not possible between the moveable member and the fixed member, at least two longitudinally extending bores, each of said bores being dimensioned to selectively accommodate an axle of a roller mounted in said track, wherein said moveable member comprises an outwardly extending flange protruding from an end edge of said body in a common direction as said longitudinally extending bores, said flange of said moveable member including an aperture which accommodates an associated fastener to selectively secure said moveable member to said fixed member, said flange of said moveable member having a width greater than a width of said body for engaging said first protruding flange of said fixed member in one position of said moveable member.

10. The assembly of claim 9, wherein said moveable member comprises three bores extending longitudinally between opposite end faces of said moveable member which are spaced from each other, centerlines of said three bores being spaced from one another.

11. The assembly of claim 9, wherein said moveable member comprises a first face and wherein one of said at least two bores is located further from said first face than is another of said at least two bores.

12. The assembly of claim 11, wherein said body of said moveable member comprises a first groove and a second groove, said second groove being located opposite said first groove.

13. The assembly of claim 12, wherein said fixed member comprises said first flange which cooperates with said first groove and a second flange which cooperates with said second groove.

14. A garage door assembly comprising:

a bottom door panel;

a track;

a cable; and a bracket assembly attached to a lower corner of said bottom door panel, said bracket assembly including:

a moveable member comprising a body including a planar surface and at least one bore for accommodating an axle of a roller which is received in said track, and a fixed member attached to said bottom door panel, said fixed member comprising:

a first panel;

a second panel oriented approximately transverse to said first panel, and a third panel oriented approximately transverse to both said first panel and said second panel, wherein said moveable member is mounted to said first panel of said fixed member, wherein once attached to said door panel, said first, second and third panels abut respective front, side and bottom surfaces of said door panel, and said planar surface of said moveable member faces said fixed member first panel, and wherein the fixed member slideably receives and interlocks with the moveable member to restrict separation of the moveable member from the fixed member, and such that pivotable movement is not possible between the moveable and fixed member.

15. The assembly of claim 14, wherein said first panel of said fixed member further comprises:

a first flange; and a second flange spaced from said first flange, each flange extending outwardly from said first panel and engaging said movable member.

16. The assembly of claim 15, wherein said moveable member comprises a first longitudinally extending shoulder which cooperates with said first flange and a second longitudinally extending shoulder which cooperates with said second flange.

17. The assembly of claim 15, wherein said fixed member further comprises a third flange to which said cable is attached.

18. The assembly of claim 14, wherein said moveable member further comprises a flange.

19. The assembly of claim 18, further comprising a fastener which cooperates with said flange to selectively secure said moveable member to said fixed member.

* * * * *